US008286314B1

(12) United States Patent
Muthusami

(10) Patent No.: US 8,286,314 B1
(45) Date of Patent: Oct. 16, 2012

(54) CREMATION REMAINS SYSTEM FOR MEMORIALIZING A DECEDENT

(76) Inventor: Jayakumar Muthusami, College Station, TX (US)

( * ) Notice: Subject to any disclaimer, the term of this patent is extended or adjusted under 35 U.S.C. 154(b) by 0 days.

(21) Appl. No.: 13/176,645

(22) Filed: Jul. 5, 2011

Related U.S. Application Data

(63) Continuation of application No. 12/359,281, filed on Jan. 23, 2009, now abandoned.

(60) Provisional application No. 61/034,951, filed on Mar. 7, 2008, provisional application No. 61/060,471, filed on Jun. 10, 2008.

(51) Int. Cl.
*A61G 17/00* (2006.01)

(52) U.S. Cl. ..... 27/1; 52/103; 297/188.13

(58) Field of Classification Search ..... 27/1; 40/124.5; 52/103–104; 211/85.27; 297/188.08, 188.13
See application file for complete search history.

(56) References Cited

U.S. PATENT DOCUMENTS

| | | | | |
|---|---|---|---|---|
| 3,460,961 | A * | 8/1969 | Markhart et al. | 428/216 |
| 5,729,921 | A * | 3/1998 | Rojas | 40/124.5 |
| 6,076,292 | A * | 6/2000 | Kawa | 40/124.5 |
| 6,463,703 | B1 * | 10/2002 | Mattis | 52/103 |
| 6,800,167 | B1 * | 10/2004 | Frazer | 156/249 |
| 6,854,165 | B1 * | 2/2005 | Parker | 27/1 |
| 6,904,721 | B1 * | 6/2005 | Forbes | 52/103 |
| 7,406,754 | B2 * | 8/2008 | Trail | 27/1 |
| 7,562,423 | B2 * | 7/2009 | Pryd-Kakuk | 27/1 |
| 7,703,185 | B2 * | 4/2010 | Trail | 27/1 |
| 2002/0132871 | A1 * | 9/2002 | Colton et al. | 522/7 |

FOREIGN PATENT DOCUMENTS

FR 2681624 A1 * 3/1993

* cited by examiner

*Primary Examiner* — William L. Miller
(74) *Attorney, Agent, or Firm* — Nick A. Nichols, Jr.

(57) ABSTRACT

In a cremation remains system for memorializing a decedent the cremation remains of the decedent are placed in a cremation remains bag and sealed in a cremation capsule. The cremation capsule is placed in a chamber formed in a memorial monument and concealed from view so that the memorial monument is not distinguishable from other cemetery memorials.

8 Claims, 4 Drawing Sheets

CREMATION REMAINS SYSTEM FOR MEMORIALIZING A DECEDENT

CROSS-REFERENCE TO RELATED APPLICATION

This is a continuation application of U.S. application Ser. No. 12/359,281 filed Jan. 23, 2009, now abandoned, which claims the benefit of U.S. Provisional Application Ser. No. 61/034,951, filed Mar. 7, 2008, and U.S. Provisional Application Ser. No. 61/060,471, filed Jun. 10, 2008, which applications are incorporated herein by reference.

BACKGROUND OF THE INVENTION

The present invention relates generally to the funeral products industry, and more particularly to a cremation remains system and the use thereof in cemetery memorials.

Cremation is a growing segment of the funeral industry and there is a growing demand for new and innovative products to personalize and commemorate the lives of the deceased by their loved ones. Consequently, the use of plastic bags or cardboard boxes to preserve and store cremation remains is not a desirable method of honoring the lives of loved ones.

There is a continuing demand in the funeral industry for new designs and styles of funeral products, particularly products that provide for a holistic approach for memorializing the lives of the deceased and bringing comfort to the family members of the deceased.

Very few options are available for family members to have an individual or family cemetery memorial for a cremated decedent without the ashes of the decedent being buried in ground or placed in a columbarium. It is therefore an object of the invention to embed cremation remains within a conventional cemetery memorial.

It is another object of the invention to conceal the embedded cremation remains within the memorial. Vandalism in cemeteries is of primary concern for families who have their beloved memorials at risk. In accordance with the invention, the cremation remains are completely concealed from view so that visitors to the cemetery and more particularly vandals will not be able to distinguish the cremation memorial from the other cemetery memorials. Only family members of the decedent and the cemetery management would know that the cremation remains of the decedent are embedded inside the memorial.

It is another object of the invention to provide family members with peace of mind that the decedent's cremation remains will not be disturbed as the cremation remains are totally concealed and the cremation memorial is non-distinguishable from the surrounding cemetery memorials.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION OF A PREFERRED EMBODIMENT

Figure 1:
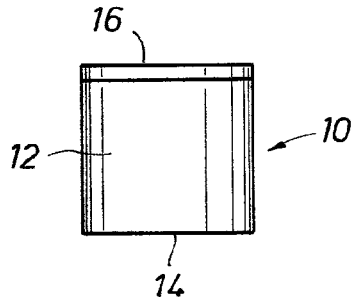
FIG. 1 is a side view of a cremation capsule of a first embodiment of the present invention.

Referring first to FIG. 1, a first embodiment of the invention is shown. A cremation capsule of the present invention is generally identified by the reference numeral 10. The capsule 10 is depicted as having a substantially cylindrical body 12 including a bottom 14 and open at the opposite end thereof. The open end of the capsule 10 is closed by a removable lid 16 for sealing the capsule 10. The capsule 10 provides a weatherproof container for storage of cremation remains. The capsule 10 is preferably made from top quality stainless steel but may be fabricated from other materials suitable to the environmental conditions of the cemetery or memorial where the remains of the deceased will be laid to rest. It will also be understood that the cylindrical configuration of the capsule 10 shown in FIG. 1 is illustrative only as the capsule 10 may be formed into many configurations as circumstances may require. The capsule 10 may also be used as a standalone urn.

The capsule 10 may be encapsulated or embedded in various cemetery memorials such as markers, benches, monuments or other specially designed vase-urns and urn-footstone combinations. The capsule 10 may be manufactured in various sizes and shapes and have different volume capacities to accommodate the storage of human and pet cremation remains. The cremation remains are sealed within the cemetery memorial and hidden from casual inspection of the memorial and thereby prevent vandalism of the cremation remains.

Figure 2:
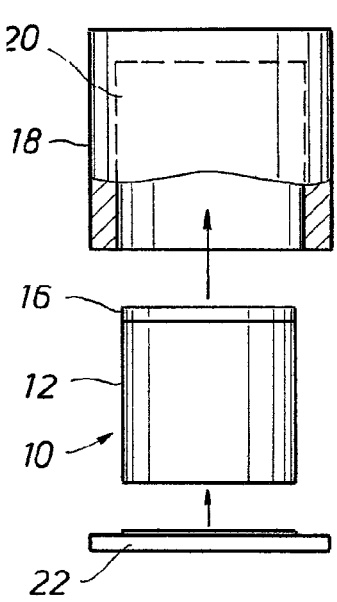
FIG. 2 is an exploded side view illustrating the encapsulation of a cremation capsule of the present invention in a footstone.

Referring now to the exploded view of FIG. 2, the capsule 10 is shown encapsulated within a footstone 18. The footstone 18 includes a chamber or cavity 20 for receiving the capsule 10. A cap stone 22 fixedly secured to the bottom of the footstone 18 seals the capsule 10 in the footstone 18.

Figure 3:
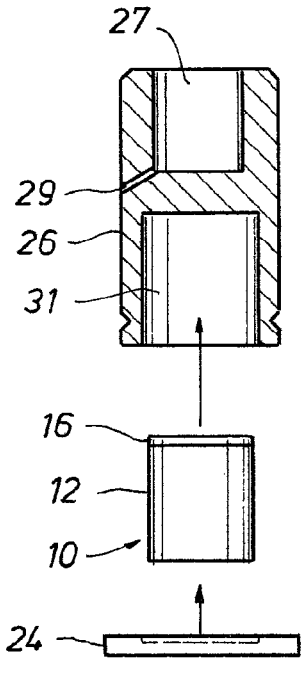
FIG. 3 is an exploded side view of a second embodiment of the present invention illustrating the encapsulation of a cremation capsule in a vase-urn.

In FIG. 3 a vase urn 26 is shown. The urn 26 is provided with a receptacle 27 for holding flowers or the like in the upper portion thereof. A passage 29 extends from the bottom of the receptacle 27 and opens on the exterior of the urn 26 providing a drainage opening for fluid, such as water, to drain from the receptacle 27. The lower portion of the urn 26 includes a receptacle 31 closed at its upper end and open at the lower end thereof. The receptacle 31 is sized to receive the cremation remains capsule 10. A cap stone 24 fixedly secured to the bottom of the urn 26 seals the capsule 10 in the urn 26.

Figure 4:
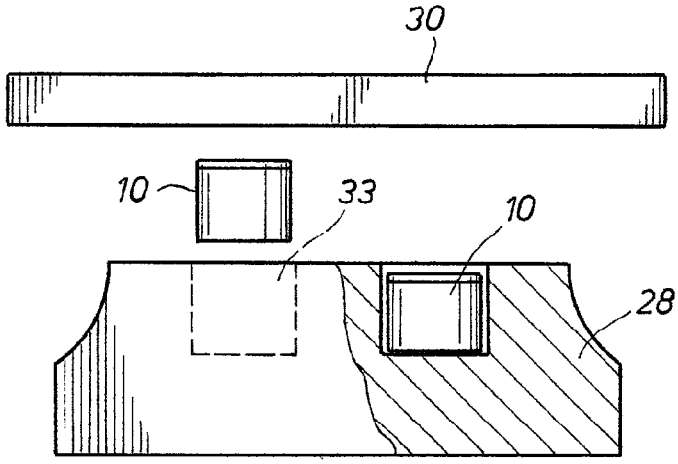
FIG. 4 is an exploded side view of a third embodiment of the present invention illustrating the encapsulation of a cremation capsule in a bench pedestal.

Referring now to FIG. 4, one or more capsules 10 may be embedded in a bench pedestal 28. The bench pedestal 28 includes a corresponding number of receptacles 33 for receiving the capsules 10. A bench seat 30 placed on top of the pedestal 28 seals the capsules 10 therein.

Figure 5:
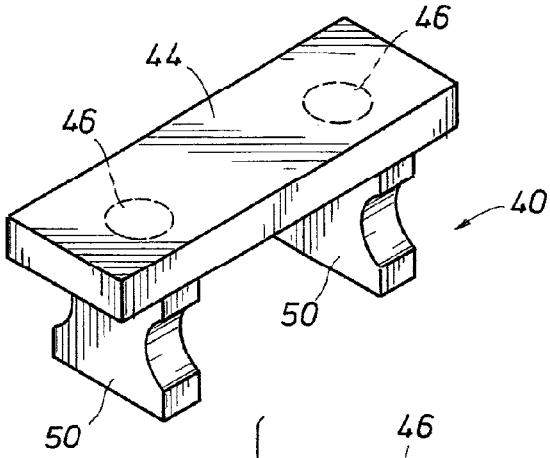
FIG. 5 is a perspective view of a fourth embodiment of the present invention illustrating cremation capsules embedded in bench memorial.
Figure 6:
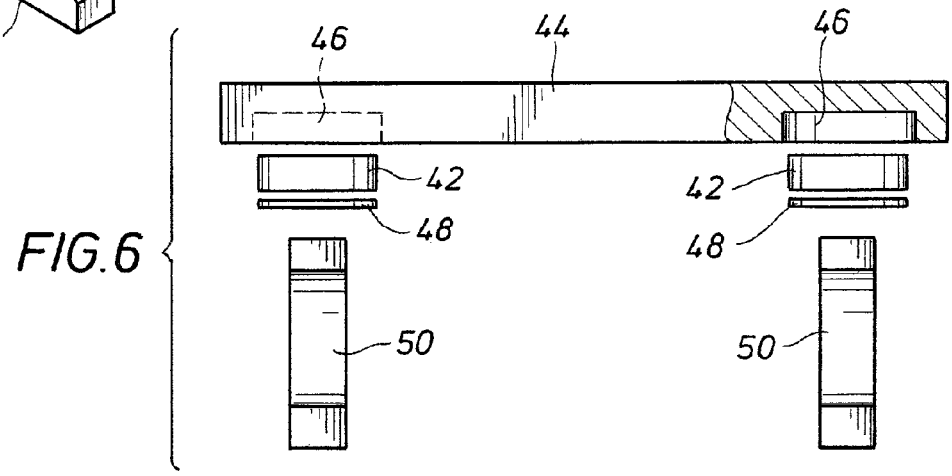
FIG. 6 is an exploded side view illustrating the encapsulation of cremation capsules in the bench shown in FIG. 5.
Figure 7:
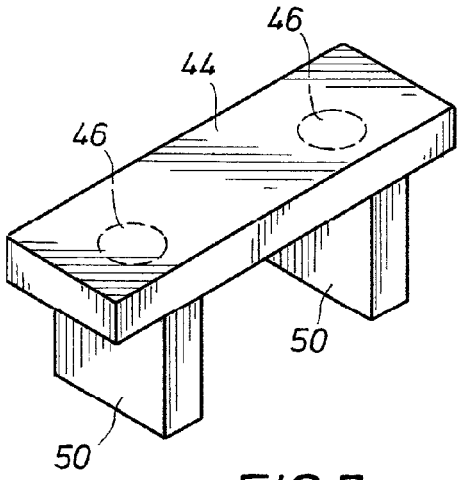
FIG. 7 is a perspective view of a fifth embodiment of the present invention illustrating cremation capsules embedded in a straight leg bench memorial.
Figure 8A:
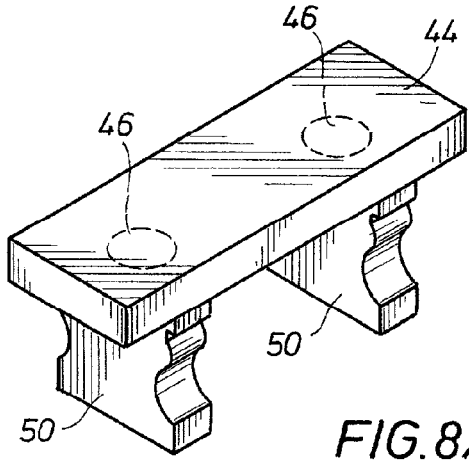
FIG. 8A is a perspective view of a sixth embodiment of the present invention illustrating cremation capsules embedded in a harp leg bench memorial.
Figure 8B:
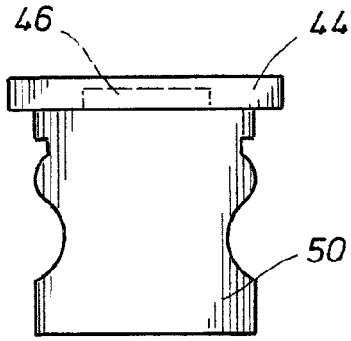
FIG. 8B is a side view of the harp leg bench memorial shown in FIG. 8A.

Referring now to FIGS. 5 and 6 a memorial bench 40 incorporating an hour glass design is shown. One or more cremation capsules 42 may be embedded in the bench seat 44. The capsule 42 is relatively short and substantially cylindrical that may easily be accommodated by the bench seat 44. One or more receptacles 46 are formed in the bench seat 44. The receptacles 46 preferably open toward the bottom surface of the bench seat 44. Capsules 42 are received in the receptacles 46 and cap stones 48 fixedly secured to the bottom of the bench seat 44 over the open ends of the receptacles 46 seal the capsules 42 in the bench seat 44. The bench seat 44 is then secured on the legs 50 of the bench 40. It is understood that the legs 50 of the bench 40 shown in FIG. 5 are not limited to an hour glass design. Other leg designs, such as the straight leg bench or harp leg bench designs shown in FIG. 7 and FIGS. 8A and 8B, respectively, are also suitable memorial bench designs.

Figure 9:
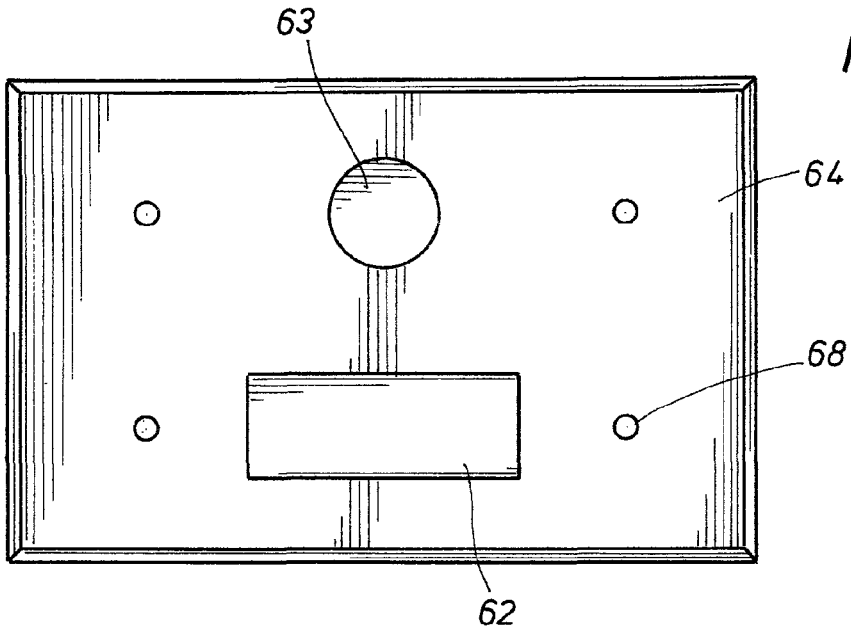
FIG. 9 is a top plan view of a seventh embodiment of the present invention illustrating cremation capsules embedded in a bronze marker.
Figure 10:
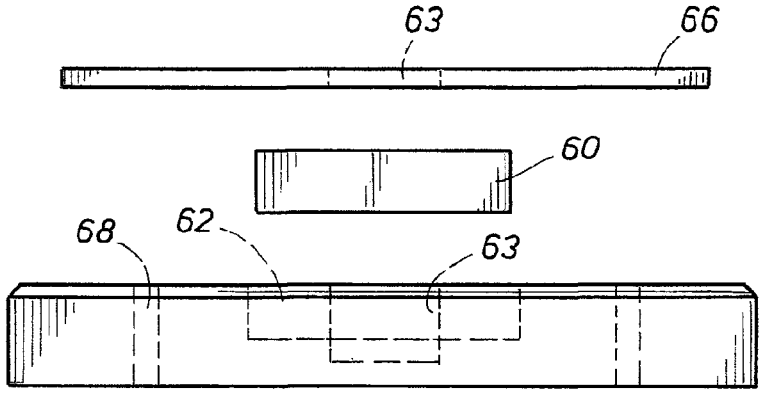
FIG. 10 is an exploded side view illustrating the encapsulation cremation capsules in the bronze marker shown in FIG. 9.

In FIGS. 9 and 10 a memorial bronze marker illustrating another embodiment of the invention is shown in exploded view. The cremation capsule 60 is relatively short and substantially rectangular in shape. It is received in a receptacle 62 formed in a marker 64. It is understood other configurations for the capsule as circumstances require may be used. Other elements may also be incorporated in the memorial. For example, the bronze marker 64 may have a vasehole 63 formed therein. A bronze plate 66 placed on top of the marker 64 seals the capsule 60 in the marker 64. Drilled holes 68 receive mounting bolts that secure the bronze plate 66 to the maker 64.

Figure 11:
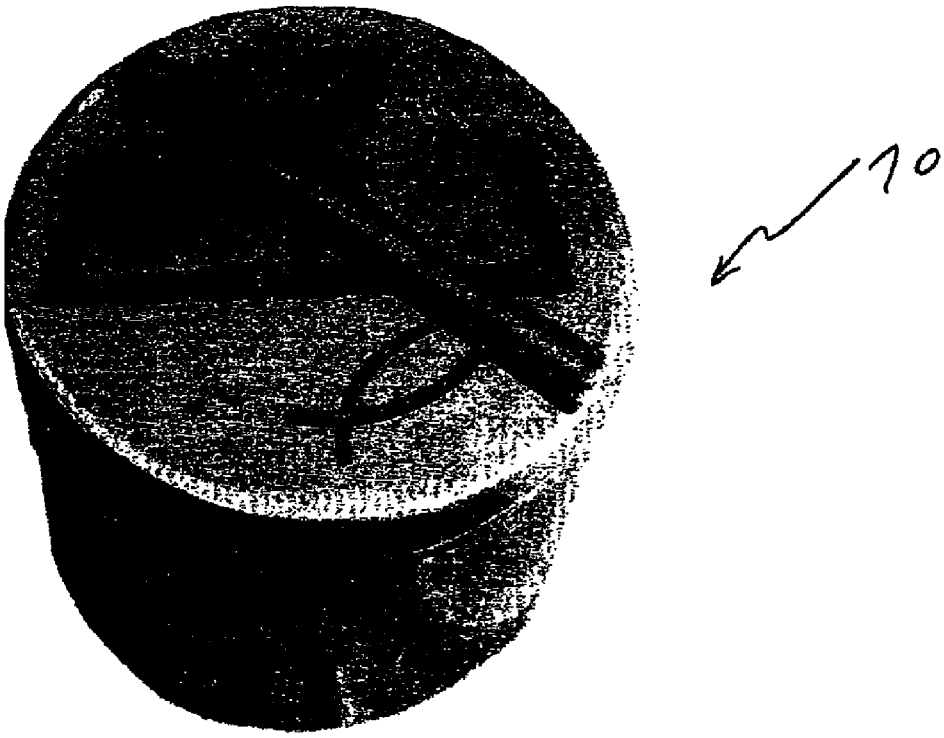
FIG. 11 is a perspective view of an eighth embodiment of the present invention illustrating ornamentation printed on a cremation capsule.
Figure 12:
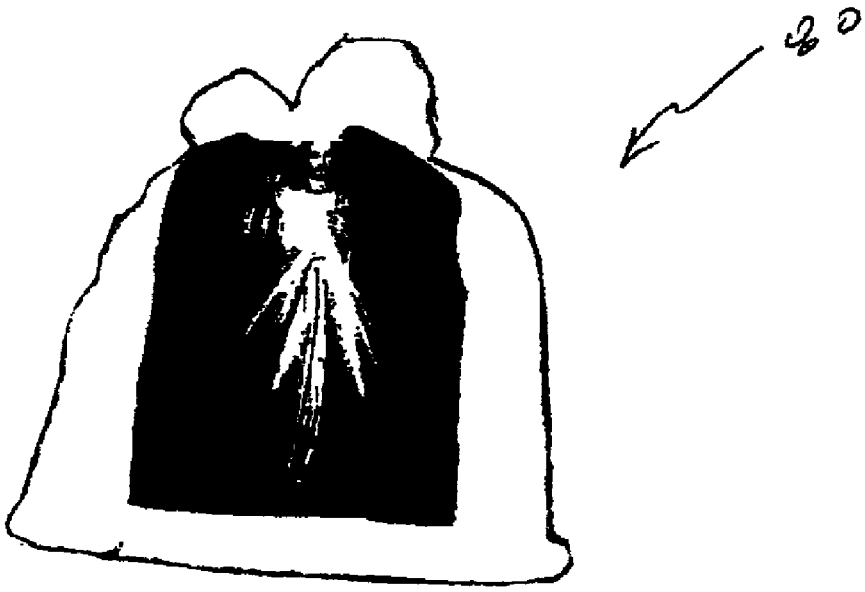
FIG. 12 is a side view of a ninth embodiment of the present invention illustrating a cremation remains bag with ornamentation.

Referring now to FIGS. 11 and 12, a cremation capsule 70 is shown in FIG. 11 and a cremation remains bag 80 is shown in FIG. 12. The cremation remains bag 80 may be made from quality velvet material or the like and adorned with decorative trim. The cremation remains of the deceased may be placed in the bag 80 which is then sealed in the capsule 70.

Digital printing on the cremation remains bags and capsules provides a meaningful way for the loved ones of the deceased to customize the cremation capsules and bags with personal messages or pictures or other ornamentation. A sample of digital printing on the cremation capsules is showing on capsule 70 shown in FIG. 11. The digital printing process of the present invention is a two step process of coating and printing. Various methods may be employed in the coating step. The coating methods may include 100% polyester or polyurethane transparent UV coating, or 100% polyester or polyurethane transparent powder coating. The printing step may include direct CO2 laser printing with marking liquid, dry based ink sublimation printing or water based ink sublimation printing.

In the above description the cremation remains system of the invention has been described in the context of sealing the cremation remains of the deceased in new cemetery memorials. It is understood, however, that the cremation remains system of the invention is equally suitable for incorporation in existing cemetery memorials. Receptacles may be formed in existing memorials and cremation capsules containing the cremation remains of the deceased as described above may be embedded and sealed in existing cemetery memorials.

While a preferred embodiment of the invention has been shown and described, other and further embodiments of the invention may be devised without departing from the basic scope thereof, and the scope thereof is determined by the claims which follow.

The invention claimed is:

1. A cremation remains system for memorializing a decedent, comprising:

a) a memorial bench comprising:

a substantially planar bench seat including oppositely facing substantially planar top and bottom surfaces;

said bench seat including one or more receptacles formed therein, wherein each of said receptacles includes an open end and an opposite closed second end, wherein each of said receptacles extends generally vertically from said bottom surface toward said top surface of said bench seat, and wherein each of said receptacles is oriented substantially perpendicular to said top and bottom surfaces of said bench seat; and seat support members secured to said bench seat and extending downward from said bottom surface of said bench seat to define legs;

b) a cremation remains capsule sized to fit within each of said receptacles, said capsule including a removable lid for sealing the cremation remains of the decedent within said capsule; and c) a cap stone removably fixed over said open end of each of said receptacles concealing said cremation remains capsule and said receptacles from view.

2. The cremation remains system of claim 1 including a cremation remains bag containing the cremation remains of the decedent.

3. The cremation remains system of claim 2 wherein said cremation remains bag includes printing on an exterior surface thereof.

4. The cremation remains system of claim 1 wherein said seat support members of said memorial bench each, define a straight leg, a harp leg, or an hour glass leg profile.

5. The cremation remains system of claim 1 wherein said cremation remains capsule includes an illustration printed on an exterior surface thereof.

6. The cremation remains system of claim 5 wherein said cremation remains capsule includes a polyester or polyurethane transparent UV coating.

7. The cremation remains system of claim 5 wherein said cremation remains capsule includes a polyester or polyurethane transparent powder coating.

8. The cremation remains system of claim 1 wherein said receptacles are sized to accommodate two or more of said cremation remains capsules.

* * * * *